United States Patent [19]

Stevens et al.

[11] Patent Number: 4,575,894

[45] Date of Patent: Mar. 18, 1986

[54] VERTICAL ACTION TOOTH BRUSH

[76] Inventors: Joy Stevens, P.O. Box 26284, Honolulu, Hi. 96825; George T. Hemmeter, 4125 Black Point Rd., Honolulu, Hi. 96816

[21] Appl. No.: 667,570

[22] Filed: Nov. 2, 1984

[51] Int. Cl.[4] ..... A46B 9/04

[52] U.S. Cl. ..... 15/172; 15/176

[58] Field of Search ..... 15/167 R, 167 A, 172, 15/176, 144 R

[56] References Cited

U.S. PATENT DOCUMENTS

| | | | |
|---|---|---|---|
| 1,968,303 | 7/1934 | McMath | 15/172 X |
| 4,330,896 | 5/1982 | Booth | 15/172 |
| 4,333,199 | 6/1982 | Del Rosario | 15/167 R |
| 4,488,328 | 12/1984 | Hyman | 15/167 R |
| 4,520,526 | 6/1985 | Peters | 15/167 R |

FOREIGN PATENT DOCUMENTS

| | | | |
|---|---|---|---|
| 245880 | 1/1926 | United Kingdom | 15/172 |
| 280748 | 11/1927 | United Kingdom | 15/144 R |

*Primary Examiner*—Peter Feldman

[57] ABSTRACT

An improved toothbrush designed for brushing along the major axis of the teeth. The bristles make an obtuse angle with the major axis of the handle. A tongue-and-groove means is provided so that the brushhead can be easily removed and replaced on the same handle. The brush mounting incorporates a resilient means for automatically promoting a wiping action to the bristles.

2 Claims, 9 Drawing Figures

VERTICAL ACTION TOOTH BRUSH

BACKGROUND OF THE INVENTION

1. Field of Invention

Almost all tooth and gum disorders and diseases result from incorrect brushing of the teeth and gums.

Notwithstanding the impressive efforts to educate both adults and children in the proper techniques of brushing advanced by Doctors of Dental Medicine and Surgery and others working in the field of dental hygiene, it is generally perceived that the majority of people do not brush correctly and effectively, even although the unfortunate consequence of improper brushing is generally well understood.

The medically recommended technique for tooth and gum brushing is to brush the gums and the fronts and backs of the teeth and to brush under the sulcus, (which is a gingival space approximately 0.008" deep) the sides of the teeth and the spaces between the teeth, principally in the direction in which the teeth grow, that is to say, toward the chewing/biting surfaces; and for the removal of plaque by application of a 'shimmy' action applied at the stems of the teeth in the gingival tissue area.

This medically recommended technique must be assiduously followed if periodontitis, (a disease that destroys the bone the teeth are rooted in) plaque build-up (plaque is a bacteria and their corrosive bacterial waste products) tooth decay, and other tooth and gum disorders and diseases are to be avoided.

A conscientious study of the medically recommended techniques for correct brushing, results in the conclusion that the 'tools' for use in implementing this prescribed technique must be of such design as will contribute effectively to, and not render difficult, the accomplishment of the desired goals. The toothbrush is the primary tool.

By our research we have determined that the overriding reason why the medically recommended techniques are not generally carried out, resulting in approximately 90% of the population suffering some degree of periodontal disease and disorder and tooth cavities, is due, largely, to the inadequate design of currently available toothbrushes.

Most currently available toothbrushes have the axis of the bristles perpendicular to the handle and in groups in line therewith. When put to use, the elbow, forearm, wrist and hand are raised and firmly hold the toothbrush horizontally. From this position the brushhead enters the mouth and the only ensuing natural action is that of horizontally scrubbing across the gums and the surfaces of the teeth. An action that is specifically discouraged by Dentists. This flawed, design-encouraged improper brushing technique resolves into the use of long, horizontal back and forth brushing strokes across the gums and front and back tooth surfaces. This brushing technique is ineffective in removing food particles and debris and therefore encourages plaque development and tooth decay. It also is a primary contributor to gum tissue destruction as well as to erosion of tooth enamel, and resultantly precipitates periodontal disease and disorder.

Our research has led to the development of the Vertical Action Tooth Brush.

As its name implies, the Vertical Action Tooth Brush has the axis of the bristles making an obtuse angle with the axis of the handle. The length of the groups of bristles at right angles to the handle is shortened so that the brush will fit any contour of the front teeth and gums.

Our aim was to develop a toothbrush that facilitates carrying out the tooth and gum brushing techniques prescribed by Dentists and, to this end, can be readily mastered by adults, children and persons of limited dexterity.

By our prototype studies, we have determined that the Vertical Action Tooth Brush, by its design, meets the requirements for a toothbrush:

a. that meets the paramaters for correct, medically prescribed techniques for brushing of teeth and gums b. that the primary demands for correct brushing through easy and natural means of application c. that provides thorough tooth and gum cleansing d. that limits or prohibits gum tissue abuse e. that limits or prohibits tooth enamel abuse f. that promotes plaque control g. that encourages proper oral hygiene through ease of operation h. requires correct tooth and gum brushing techniques i. that promotes healthier gums and teeth j. that prevents loss of teeth through gum disorders k. that prevents gum tissue damage that results in periodontal diseases and disorders.

2. Description of Prior Art

Most currently available toothbrushes have the axis of the bristles perpendicular to the handle and in groups in line therewith. This shape, and construction:

a. encourages sideways scrubbing across the teeth and gums in direct opposition to the recommended technique for safe and successful oral hygiene, and, b. makes mastering the recommended technique for correct brushing of teeth and gums almost impossible to accomplish, simply because it is so awkward and unnatural to hand, wrist and arm action.

Because of this, adults experience such difficulty that they ignore the recommended brushing techniques and, also because of this, children whose coordination is even less, cannot master the recommended technique and therefore resort to horizontal brushing which leads to severe and serious dental problems.

OBJECTS OF THIS INVENTION

An object of this invention is to provide a Vertical Action Tooth Brush that, by its design, is very easy to use in the correct technique of tooth and gum brushing, by persons of all ages and of varying dexterity, because the operation of the brush is entirely natural to hand-wrist-arm motion and does not necessitate a horizontal push-pull action of the arm in concert with a rotary action of the wrist.

An object of this invention is to provide a Vertical Action Tooth Brush that, by its design does a superior job for persons of all ages and of varying dexterity, in tooth and gum cleansing, all in accordance with recomended techniques and resulting in severely limiting tooth and gum disorders and diseases.

An object of this invention is to provide a Vertical Action Tooth Brush that, by its design is compelled and restricted to brushing over the gum, under the sulcus, between the teeth and always only in the direction of the chewing/biting surfaces. This results in accomplishing the recommended technique for tooth and gum brushing, plaque removal and effective tooth cleansing.

An object of this invention is to provide a Vertical Action Tooth Brush that, by its design reaches with equal ease and effectiveness all front tooth and gum surfaces, both upper and lower.

An object of this invention is to develop a Vertical Action Tooth Brush that restricts all tooth and gum cleansing for both front and back surfaces to the correct brushing technique.

An object of this invention is to develop a toothbrush that provides for easy and correct horizontal brushing of all chewing/biting surfaces.

An object of this invention is to provide a Vertical Action Tooth Brush that, by its design discourages and restricts horizontal brushing back and forth across front and back, upper and lower, tooth and gum surfaces, thereby removing this potential for abrasion and erosion at the 'necks' of the teeth which ultimately leads to periodontal disorders.

An object of this invention is to develop a Vertical Action Tooth Brush that, by its design, initiates with every brush stroke, the recommended plaque removal technique.

An object of this invention is to develop a Vertical Action Tooth Brush that, by its design limits the possibility of damaging gingival tissue, thereby limiting to the same degree, the single highest contributing factor in tooth and gum diseases and disorders.

An object of this invention is to provide a Vertical Action Tooth Brush that, by its design, is natural to the recommended 'shimmy' technique for plaque removal and, at the same time, limits the potential for carelesness in the application of this technique.

An object of this invention is to develop a Vertical Action Tooth Brush whereby the obtuse angle between the axis of the handle and the axis of the bristles limits excessive damaging pressure upon delicate gingival tissues and yet promotes ease in reaching horizontal chewing/biting surfaces.

An object of this invention is to develop a Vertical Action Tooth Brush that, by its design will provide a toothbrush wherein the head can be readily removable from the handle for exchange or replacement with firmer or softer bristles as so desired.

An object of this invention is to develop a Vertical Action Tooth Brush that places the bristles in the workable range of angles to afford proper servicing of all tooth and gum surfaces.

DESCRIPTION OF PREFERRED EMBODIMENT

Figure 1:
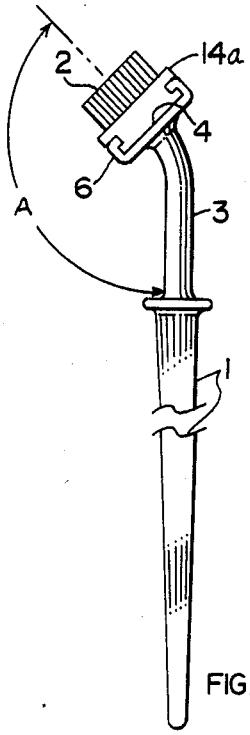
FIG. 1 is a side view of a Vertical Action Tooth Brush showing the removable brush held in position by a clamping means.

Before explaining the present invention in detail it is to be understood that the invention is not limited in its application to the details of construction and arrangements of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings wherein like reference numerals refer to like and corresponding parts throughout the several views, the preferred embodiment of the invention is disclosed in FIGS. 1 through 9 inclusive.

Figure 3:
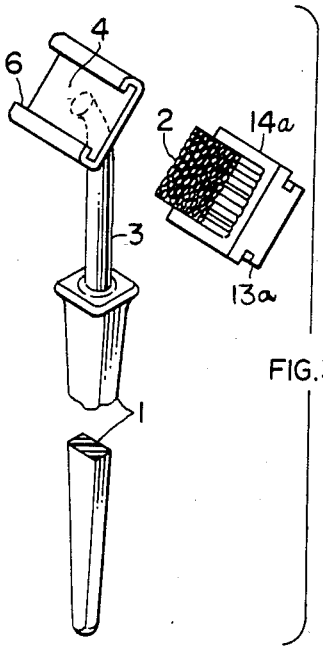
FIG. 3 is a perspective exploded view of same, showing the brush removed.
Figure 4:
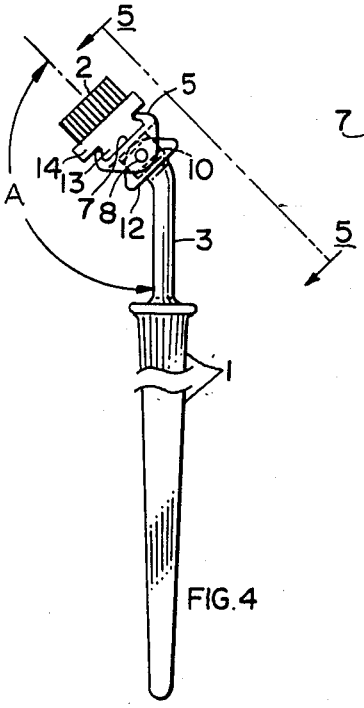
FIG. 4 is a side view of a Vertical Action Tooth Brush with a swivel brush head.
Figure 6:
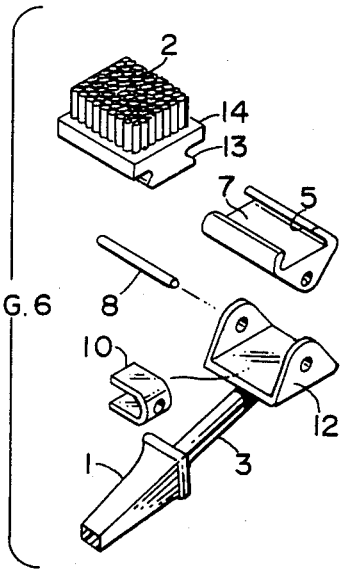
FIG. 6 is an exploded view of a Vertical Action Tooth Brush with a swivel brush head and with a "C" clip spring stabilizer.
Figure 7:
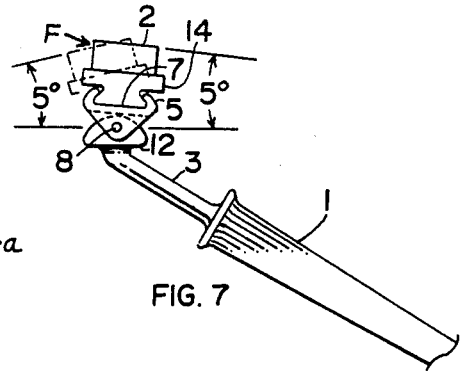
FIG. 7 is a sectional side view of a swivel head Vertical Action Tooth Brush using a "C" clip spring showing 5° angular displacement in both directions when a disturbing force is applied.

This Vertical Action Tooth Brush includes essentially a handle 1, the axis of which makes an obtuse angle A with the axis of the brush bristles 2 of FIGS. 1 and 4. The width of the Brush 2 is less than the width of a conventional toothbrush, so that it can follow the contour of the front teeth, on their inner surfaces. In order to meet this requirement the brush width should preferably be under ¾ths of an inch. The brush head is connected to the handle with a small diameter goose-neck 3 so as not to interfere with the vertical action during brushing the molars. A brush-holding platform 4 is attached to the goose-neck 3, said platform 4 is formed either with a dove-tailed holder 5 as shown in FIGS. 4, 6 and 7, or with a "C" clamp as shown in FIGS. 1, 3, 8 and 9. Mateing tracks 13 and 13*a* are provided on the brush heads 14 and 14*a*, to firmly hold the brush in place during brushing but give access for brush removal and replacement when desired. This feature is unnecessary to the primary invention and can be eliminated if desired without altering the effectiveness of the Vertical Action Tooth Brush in operation.

Figure 2:
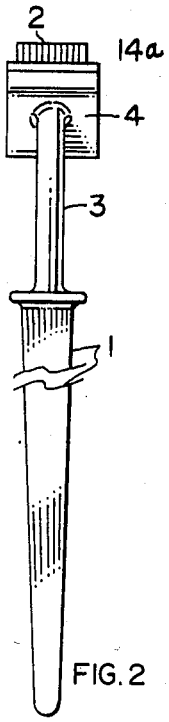
FIG. 2 is a rear view of same.

In order to provide a wiping action to the brush without tilting the hand backward and forward during brushing as required with the Vertical Action Tooth Brush shown in FIGS. 1, 2 and 3, we have invented a pivotably mounted head as shown in FIG. 4 through 9, wherein the brush holder 7 is pivotably mounted on the U-shaped holder 12 and held in place by pin 8 on which it swivels. Angular movement is restricted by the rubber block 9 of FIGS. 8 and 9 or by the "C" clamp spring 10 in FIGS. 6 and 7.

Figure 5:
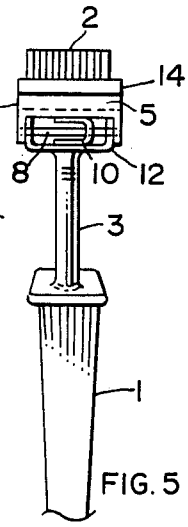
FIG. 5 is a rear view of a Vertical Action Tooth Brush taken in the direction 5—5 of FIG. 4.
Figure 8:
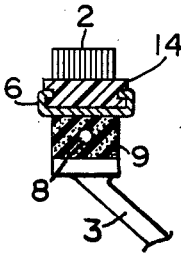
FIG. 8 is a sectional side view A—A of the Vertical Action Tooth Brush equipped with a rubber block stabilizer.
Figure 9:
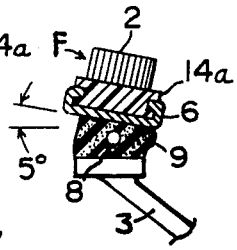
FIG. 9 is the same view as in FIG. 8 with the Vertical Action Tooth Brush displaced 5° due to a disturbing Force F.

When a force F is applied by the teeth on to the pivotably mounted bristle brush shown in FIG. 7 and 9, the platform 7 is caused to rotate slightly on pin 8 against the action f the rubber block 9 of FIGS. 8 and 9 or compression of the "C" clamp spring 10 of FIGS. 5 and 6. This motion enables the bristles to be dragged over the teeth and also allows the bristles to get under the gum to remove plaque. Note in FIG. 8 how the rubber block 9 is compressed on one edge to resist rotation caused by the cleaning vertical action. Likewise a restrictive force against rotation is provided by the "C" clamp 10 spring of FIGS. 5 through 7, FIG. 7 shows the brush deflected angularly 5° in either clockwise or counter-clockwise direction as would happen in the up and down stroke in the Vertical Action Tooth Brush.

We claim as our invention:

1. In a toothbrush intended for brushing action substantially in both directions of the major axis of the teeth being cleansed, said toothbrush having an elongated handle supporting at one end of its extremity a mounting platform, said platform having an axle placed at right angles to the major axis of said handle, pivotally mounted on said axle, for limited angular turning movement thereon is a bristle brush-holder, a resilient means is provided between said mounting platform and said brush-holder to allow restrictive turning movement of the brush-holder on said axle with respect to the mounting platform, both said mounting platform and said bristle brush-holder being mounted to make an obtuse angle with respect to said major axis of the handle.

2. An improved toothbrush as recited in claim 1 wherein said brush-holder is provided with a tongue and groove system to allow removal and replacement of said bristle brush on said handle.

* * * * *